US007047581B2

(12) United States Patent
Gladney

(10) Patent No.: US 7,047,581 B2
(45) Date of Patent: May 23, 2006

(54) STRANDED MATTRESS SPRING

(75) Inventor: Richard F. Gladney, Fairburn, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 10/371,177

(22) Filed: Feb. 19, 2003

(65) Prior Publication Data

US 2004/0158929 A1 Aug. 19, 2004

(51) Int. Cl.
*A47C 23/04* (2006.01)
*A47C 27/04* (2006.01)
*F16F 1/06* (2006.01)
*F16F 3/93* (2006.01)

(52) U.S. Cl. ..... 5/716; 5/655.7; 5/256; 267/180

(58) Field of Classification Search ..... 5/716, 5/654.1, 655.7, 642, 256, 720, 655.8; 267/166, 267/167, 180
See application file for complete search history.

(56) References Cited

U.S. PATENT DOCUMENTS 15,869 A * 10/1856 French ..... 267/166
99,475 A * 2/1870 Rhinelander ..... 267/166
274,715 A * 3/1883 Buckley ..... 267/180
374,658 A * 12/1887 Collom ..... 5/256
683,344 A * 9/1901 Sim ..... 5/258
685,160 A * 10/1901 Marshall ..... 5/720
837,751 A 12/1906 Summers
1,192,510 A 7/1916 Fischmann
1,451,936 A * 4/1923 Young ..... 29/896.92
1,493,179 A * 5/1924 Young et al. ..... 5/256
1,544,237 A * 6/1925 Karr ..... 5/256
2,398,237 A 4/1946 Marsack
3,985,097 A * 10/1976 Sitton ..... 118/425
4,025,681 A 5/1977 Donnelly et al. ..... 428/116
4,473,217 A * 9/1984 Hashimoto ..... 267/149
4,753,423 A * 6/1988 Ukai et al. ..... 267/286
4,811,439 A 3/1989 Siegel et al. ..... 5/718
4,869,471 A * 9/1989 Schwarz et al. ..... 267/33
4,889,327 A * 12/1989 Seyler ..... 267/168
4,983,144 A * 1/1991 Ojima ..... 474/111
4,991,827 A * 2/1991 Taylor ..... 267/149
5,098,493 A * 3/1992 Taylor ..... 156/87
5,210,890 A 5/1993 Hagglund ..... 5/239
5,310,167 A * 5/1994 Noll, Jr. ..... 267/33
5,548,898 A * 8/1996 Noll, Jr. ..... 29/896.91
5,756,022 A 5/1998 Siegel et al. ..... 264/46.7
5,868,383 A 2/1999 Codos
6,220,586 B1 * 4/2001 Pavlin et al. ..... 267/155

(Continued)

FOREIGN PATENT DOCUMENTS

DE 815 907 10/1951

(Continued)

OTHER PUBLICATIONS

Wallingford Bicycle Parts (http://www.wallbike.com/Products.html) The BROOKS B.33 Saddle.

(Continued)

*Primary Examiner*—Robert G. Santos
(74) *Attorney, Agent, or Firm*—Fish & Neave IP Group Ropes & Gray LLP

(57) ABSTRACT

A mattress construction with a stranded wire spring is disclosed. The stranded wire spring can be designed with the same performance characteristic as a conventional single strand coil spring, but at a lower manufacturing and material cost.

15 Claims, 1 Drawing Sheet

Stranded Wire Coil

U.S. PATENT DOCUMENTS

| | | | | |
|---|---|---|---|---|
| 6,295,891 | B1 * | 10/2001 | Velte et al. | 74/513 |
| 2004/0158929 | A1 * | 8/2004 | Gladney | 5/716 |
| 2004/0158930 | A1 * | 8/2004 | Gladney | 5/716 |
| 2005/0005354 | A1 * | 1/2005 | Gladney et al. | 5/256 |

FOREIGN PATENT DOCUMENTS

| | | | | |
|---|---|---|---|---|
| DE | 002620149 | B1 * | 11/1977 | |
| GB | 000020583 | * | 6/1911 | 5/256 |
| JP | 357069123 | A * | 4/1982 | |
| JP | 357069125 | A * | 4/1982 | |
| JP | 357069126 | A * | 4/1982 | |

OTHER PUBLICATIONS

The Deactivated Gun Collector's Association (SIG-Sauer P225).

* cited by examiner

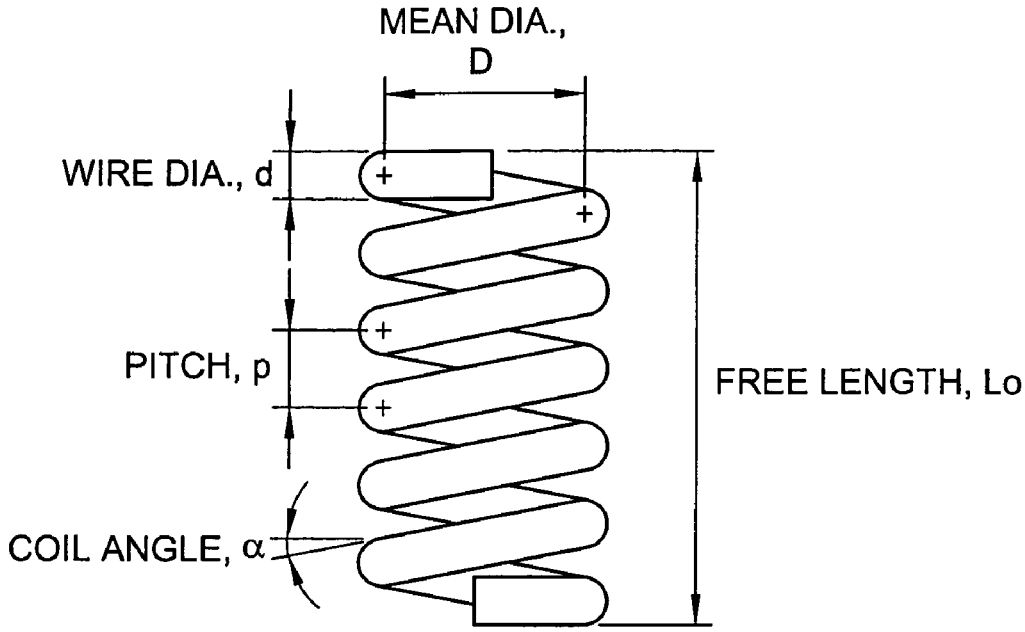
Figure 1, Conventional Compression Spring
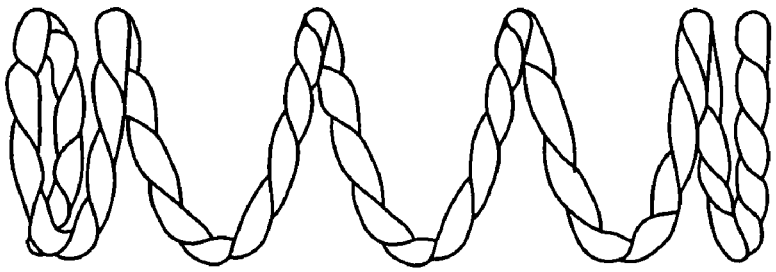
Figure 2, Stranded Wire Coil

STRANDED MATTRESS SPRING

BACKGROUND OF THE INVENTION

A standard bed construction which has been popular for some time includes a frame for supporting a box spring. The box spring, in turn, is designed to support a mattress. Mattresses are available in a variety of sizes and are also constructed in various ways. One such construction which has proved to be highly desirable includes the use of an innerspring comprising a plurality of discrete coil springs which can be encapsulated in individual fabric pockets joined together in a string. An assembly of this type is known as Marshall construction and is disclosed, for example, in U.S. Pat. No. 4,234,983, issued to Stumpf, the disclosure of which is incorporated herein by reference. Once the strings of coils are formed, they may be arranged in any desired fashion such as a chevron or other pattern to provide an innerspring assembly in which the individual springs all have longitudinal axes oriented parallel one to another and the springs are closely packed together in an array having a generally rectangular shape in plan with the ends of the springs lying in a common plane. A suitable quilted foam pad of preselected thickness may then be used to cover the innerspring and provide a generally planar surface on which a person can sleep. Preferably, the innerspring is covered on both sides and has fabric edging connecting the opposed surface covers, thereby defining a unitary mattress assembly.

Each coil is typically manufactured from a single steel wire that is coiled using an apparatus disclosed, for example, in U.S. Pat. No. 4,401,501 also issued to Stumpf, the disclosure of which is likewise incorporated herein by reference. The spring characteristic is defined, among others, by the wire size and spring dimensions (pitch, coil length, coil diameter, etc.) which can be selected according to the desired properties of the seating or resting surface of the article of furniture or mattress in a manner known in the art.

Although coils of the aforedescribed type have been used almost exclusively in the construction of seating or resting surfaces, they are not inexpensive and severely impair the seating or sleeping comfort if one or more springs malfunction, for example, break.

It would therefore be desirable to provide a spring construction that is less expensive to manufacture than a solid wire spring while retaining the advantageous performance characteristic of the solid wire speing.

SUMMARY OF THE INVENTION

The invention is directed to a spring support for a seating or resting surface for an article of furniture, and more particularly to a stranded wire coil and a mattress assembly with a stranded wire coil.

According to one aspect of the invention, a spring for an article of furniture with a predetermined spring characteristic is fabricated of a plurality of stranded wires that are joined at the respective ends of the spring. The individual strands of the spring all have a helix so that there is no central wire in the spring design. The helix of the wires opposes the helix of the spring so that the strands are urged against each other when the spring is compressed.

Additional embodiments may include one or more of the following features. The individual wire are given the helical twist before the wires are stranded and the coil is formed, wherein the direction of the helical twist is opposite to the twist direction of the stranded coil spring. A torque is applied to the cord wire during coiling to prevent it from being loosened when the stranded wires are formed into the coil.

To lessen the adverse effects caused by rubbing of the strands against each other and wear, the strands can be coated before being stranded, for example, with Teflon or another material that reduces friction and can withstand the processing temperatures (annealing) of the stranded wires. Moreover, the strands can be protected by a metallurgical process, such as galvanization, while the stranded wires can be overcoated in addition with a plastic coating for additional protection against the environment.

Further features and advantages of the present invention will be apparent from the following description of preferred embodiments and from the claims.

BRIEF DESCRIPTION OF THE DRAWINGS

The following figures depict certain illustrative embodiments of the invention in which like reference numerals refer to like elements. These depicted embodiments are to be understood as illustrative of the invention and not as limiting in any way.

FIG. 1 shows schematically a conventional closed end coil spring; and

FIG. 2 shows schematically an embodiment of a stranded wire spring.

DETAILED DESCRIPTION OF CERTAIN ILLUSTRATED EMBODIMENTS

The invention is directed to stranded coils for seating and resting surfaces of articles of furniture. In particular, the stranded coil construction described herein can be a less expensive replacement for single strand wire coils in mattresses, while providing the same utility and performance. For purpose of illustration, the coils described herein will be described with reference to pocketed coil mattresses, however the invention is not so limited and may be employed with open-coil mattresses, seat cushions, car seats, flooring, and other products.

FIG. 1 illustrates the basic geometric parameters defining the helical compression spring. The primary spring geometric design parameters are: Free Length ($L_o$) representing the length of the unloaded spring; Wire Diameter (d) representing the diameter of the wire that is wound into a helix; Coil Diameter (D) representing the mean diameter of the helix, i.e., $(D_{outer}+D_{inner})/2$; and Total Number of Coils ($N_t$) representing the number of turns in the spring. Other useful design parameters are: Active Coils ($N_a$) representing the number of coils which actually deform when the spring is loaded, as opposed to the inactive turns at each end which are in contact with the spring seat or base; Solid Length ($L_s$) representing the minimum length of the spring, when the load is sufficiently large to close all the gaps between the coils; and Pitch (p) representing the distance from center to center of the wire in adjacent active coils. Springs in seating and resting surfaces of articles of furniture typically employ closed end springs of the type illustrated in FIG. 1. Closed end springs are typically assumed to have at most one inactive coil at each end of the spring.

The selection of the spring material is usually the first step in parametric spring design. Material selection may be based on a number of factors, including temperature range, tensile strength, elastic modulus, fatigue life, corrosion resistance, cost, etc. High-carbon spring steels are the most commonly used of all springs materials. They are relatively inexpensive, readily available, and easily worked. Examples include Music Wire (ASTM A228) and Hard Drawn (ASTM A227) wire, which are suitable for springs used, for example, in mattresses. Spring wires can be surface-treated, such as galvanized or coated with a plastic or epoxy.

Spring wire used in mattress coil spring construction has typically a diameter of between approximately 0.06" (16 gauge) and approximately 0.09" (13 gauge), with each coil spring made of a single strand of spring wire. The exact design parameters for mattress coil springs depends on the desired firmness, which is in addition determined by the number of springs per unit surface area of the mattress.

The proposed alternative coil spring construction for use in a seating or sleeping application employs a stranded wire spring which is made of at least 2 wire strands that are twisted to form a multi-wire cord. The number of strands employed will vary according to the application and may vary based on the type of material used to form the strand. Thus, the braided wire may include two or more strands, and typically will include from three to fifty strands. This stranded wire spring can be manufactured less expensively than a single-stranded wire spring, while retaining the advantageous performance characteristics of the single-stranded spring.

FIG. 2 shows schematically a closed end 3-cord stranded wire spring having an outside diameter of approximately 2" and $N_t$=6 coils, with one coil being an inactive coil, as defined above. An exemplary free length $L_0$ is between 5" and 6". The proposed spring can be made, for example, of carbon steel, such as ASTM A227/A228, with each strand having an outside diameter of 0.514" (1.3 mm), which is equivalent to a 17½ gauge. With these parameters, the spring rate is approximately 1.4 lb which gives the following characteristic:

| Working Deflection (inches) | Working Load (lbf) |
|---|---|
| 0.75 | 1.07 |
| 1.0 | 1.43 |
| 2.5 | 3.57 |
| 3.0 | 4.28 |

The fatigue performance of the illustrated stranded spring design is estimated to be between 100,000 and 1,000,000 operation cycles at 2.75" deflection, which corresponds to a useful life of approximately 15 years. The efficiency and performance of the spring is understood to increase with the number of strands. However, the cost also tends to increase with the number of strands. It has been estimated that the spring will suffer no more than 5% relaxation over 15 years when deflected by 2.75".

Stranded springs have the advantage of remaining functional even when one or more of the strands breaks. The strands may be twisted, weaved, clipped or bonded together and any suitable method for forming the stranded wire spring may be employed without departing from the scope of the invention. The strands may be steel, aluminum, plastic, copper, titanium, rubber or any other suitable material and the type of material selected will depend upon the application at hand. Morever, the strands may have any suitable shape and may be long cylindrical wires, hexagonal wire, square wire or any other shape or geometry. Additionally, the wire strand gauge may vary according to the application and in one embodiment comprises 710 gauge wire, although other gauges may be used.

The exemplary stranded coil spring illustrated in FIG. 2 can be fabricated by initially providing the individual wires (strands) with a helical twist prior to the stranding operation. The helix of the stranded spring itself preferably opposes the helix of the individual wires to counteract a tendency of the strand elements to loosen when the spring is operated, i.e., compressed. Additionally, as with conventional springs, a torque is applied to the cord wire during coiling.

In one practice, coiling may be achieved construction by passing a braided strand through a coiler, such as the type of coiler employed for forming steel mattress coils wherein a heavy-gauge steel wire is compressed into a barrel-shaped coil such that no turns touch for eliminating noise and vibration. The coils may then be passed to a pocketing machine or station to pocket the springs into individual sleeves of a non-woven, non-allergenic fabric such as Duon. Each sleeve may be ultrasonically sealed, a process where the fibers are melted together to form solid plastic seams that are secure and tear-resistant. The coils are then fusion bonded to produce a strong, stable construction. The number of coils in each unit may vary, and the types of coils and the number of strands and gauge of strands can vary from pocket to pocket.

The individual strands are connected with each other at least at the ends of the coil. Since the strands can rub against each other over the length of the coil, which can cause fretting and premature wear, the strands may be coated and/or pre-galvanized. Moreover, the stranded coil may also be sealed with a sealant, such as an epoxy. Thus, in alternative and optional embodiments, the strands may be coated or otherwise treated and the wire may be sealed or coated.

While the invention has been disclosed in connection with the illustrated embodiments shown and described in detail, various modifications and improvements thereon will become readily apparent to those skilled in the art. For example, the stranded coils described herein can be of any suitable diameter or height. The mattresses can be one sided, foam-encased and uni-directional. They can provide main springs and joey coils, and optionally provide for multiple firmness as well as gradients of firmness. They can be used for pocketed coil mattresses and open-coil mattresses. They can be used in seat cushions, car seat cushions and sofas. Accordingly, the spirit and scope of the invention is to be limited only by the following claims.

The invention claimed is:

1. A mattress assembly with a plurality of stranded coil springs arranged to define a mattress core structure, comprising a plurality of said stranded coil springs positioned in substantially parallel alignment to each of the other plurality of stranded coil springs, with longitudinal top ends of the stranded coil springs lying in a substantially common plane perpendicular to the longitudinal axes of said stranded coil springs to provide a top planar mattress surface; and at least a plurality of said stranded coil springs having a predetermined spring characteristic and being fabricated of a stranded wire formed from a plurality of wire strands that are in continuous contact from one end of the spring to the other end, to provide said plurality of said stranded coil springs with closed ends.

2. The assembly of claim 1, wherein each of the wire strands has a helical twist with a direction that is opposite to a twist direction of the stranded coil spring.

3. The assembly of claim 1, comprising at least three wires strands.

4. The assembly of claim 1, wherein the stranded wires are provided with a protective coating selected from the group consisting of galvanized exterior, plastic and epoxy overcoating.

5. The assembly of claim 1, wherein the stranded coil spring is provided with a protective coating.

6. The assembly of claim 1, wherein the stranded coil spring is constructed so as not to have a central cord.

7. The assembly of claim 1, wherein the mattress core comprises a pocketed coil mattress core.

8. The assembly of claim 1, wherein the mattress core comprises an open-coil mattress core.

9. Method of manufacturing a mattress assembly with a plurality of stranded coil springs arranged to define a mattress core, comprising:

forming a spring wire being helically twisted in a first twist direction;

combining a plurality at least three of the helically twisted spring wires and twisting the combined spring wires in a direction opposite the first twist direction to form a stranded coil spring; and positioning said stranded coil springs in substantially parallel alignment to the other plurality of stranded coil springs, with the longitudinal top ends of all the stranded coil springs lying in a substantially common plane perpendicular to the longitudinal axes of said stranded coil springs to provide a top planar mattress surface defined by said ends of said springs.

10. The method of claim 9, further comprising joining the plurality of stranded wires at least at respective ends of the spring.

11. The method of claim 9, further comprising applying a protective coating on the stranded wires.

12. The method of claim 11, wherein the protective coating is selected from the group consisting of galvanization, plastic and epoxy overcoating.

13. The method of claim 9, further comprising applying a protective coating on the stranded coil spring.

14. The method of claim 9, wherein the stranded coil spring is formed without a central cord.

15. The method of claim 9, wherein forming a spring wire being helically twisted in a first twist direction includes, passing a twisted wire braid through a wire coiler machine.

* * * * *

UNITED STATES PATENT AND TRADEMARK OFFICE

CERTIFICATE OF CORRECTION

PATENT NO. : 7,047,581 B2
APPLICATION NO. : 10/371177
DATED : May 23, 2006
INVENTOR(S) : Gladney et al.

It is certified that error appears in the above-identified patent and that said Letters Patent is hereby corrected as shown below:

On cover page, under Inventor, add --Michael S. DeFranks, Decatur, GA--

Signed and Sealed this

Twenty-second Day of August, 2006

JON W. DUDAS
*Director of the United States Patent and Trademark Office*